US007209089B2

(12) United States Patent
Schantz

(10) Patent No.: US 7,209,089 B2
(45) Date of Patent: Apr. 24, 2007

(54) BROADBAND ELECTRIC-MAGNETIC ANTENNA APPARATUS AND METHOD

(76) Inventor: Hans Gregory Schantz, 515 Sparkman Dr., Huntsville, AL (US) 35816

( * ) Notice: Subject to any disclaimer, the term of this patent is extended or adjusted under 35 U.S.C. 154(b) by 0 days.

(21) Appl. No.: 11/040,077

(22) Filed: Jan. 21, 2005

(65) Prior Publication Data

US 2005/0162332 A1 Jul. 28, 2005

Related U.S. Application Data

(60) Provisional application No. 60/538,187, filed on Jan. 22, 2004.

(51) Int. Cl.

| | |
|---|---|
| ***H01Q 1/00*** | (2006.01) |
| ***H01Q 9/28*** | (2006.01) |
| ***H01Q 21/26*** | (2006.01) |
| ***H01Q 21/00*** | (2006.01) |

(52) U.S. Cl. ..... 343/787; 343/795; 343/797; 343/867

(58) Field of Classification Search ..... 343/793, 343/795, 797, 866, 867, 787
See application file for complete search history.

(56) References Cited

U.S. PATENT DOCUMENTS

| | | | | |
|---|---|---|---|---|
| 1,892,221 | A | | 12/1932 | Runge |
| 2,256,619 | A | | 9/1941 | Luck |
| 2,282,030 | A | | 5/1942 | Busignies |
| 2,460,260 | A | | 1/1949 | Kibler |
| 2,465,379 | A | | 3/1949 | Kandoian |
| 2,521,550 | A | | 9/1950 | Smith |
| 2,695,406 | A | | 11/1954 | Byatt et al. |
| 2,953,782 | A | | 9/1960 | Byatt |
| 3,105,236 | A | | 9/1963 | McCloud |
| 3,364,491 | A | | 1/1968 | Stohr |
| 3,576,567 | A | | 4/1971 | Shively |
| 3,763,419 | A | * | 10/1973 | Barringer ..... 324/334 |
| 3,882,506 | A | | 5/1975 | Mori et al. |
| 3,942,180 | A | | 3/1976 | Rannou et al. |
| 4,038,661 | A | | 7/1977 | Nolte |
| 4,500,887 | A | | 2/1985 | Nester |
| 4,764,773 | A | | 8/1988 | Larsen et al. |
| 4,794,319 | A | | 12/1988 | Shimazaki |
| 4,809,009 | A | | 2/1989 | Grimes et al. |
| 4,843,403 | A | | 6/1989 | Lalezari et al. |
| 5,155,495 | A | | 10/1992 | Hately et al. |

(Continued)

FOREIGN PATENT DOCUMENTS

| | | |
|---|---|---|
| GB | 1593552 | 10/1977 |

OTHER PUBLICATIONS

L.J. Chu, "Physical Limitations of Omnidirectional Antennas," Journal of Applied Physics, 19, 1948, pp. 1163-1175.

(Continued)

*Primary Examiner*—Shih-Chao Chen

(57) ABSTRACT

The present invention is directed to a broadband electric-magnetic antenna apparatus and method. The present invention teaches a variety of electric antennas suitable for use in the present invention as well as a variety of magnetic antennas suitable for use in the present invention. Combination of a broadband electric antenna element and a broadband magnetic element to create a broadband electric-magnetic antenna system is discussed. This invention further teaches systems for using a broadband electric magnetic antenna system to radiate or receive quadrature signals.

16 Claims, 4 Drawing Sheets

U.S. PATENT DOCUMENTS

| | | | | |
|---|---|---|---|---|
| 5,274,388 | A | 12/1993 | Ishizaki et al. | |
| 5,300,885 | A | 4/1994 | Bull | |
| 5,319,377 | A | 6/1994 | Thomas et al. | |
| 5,426,439 | A | 6/1995 | Grossman | |
| 5,465,099 | A | 11/1995 | Mitsui et al. | |
| 5,764,696 | A | 6/1998 | Barnes et al. | |
| 5,872,546 | A | 2/1999 | Ihara et al. | |
| 6,091,374 | A | 7/2000 | Barnes | |
| 6,211,846 | B1 | 4/2001 | Gouin | |
| 6,400,329 | B1 | 6/2002 | Barnes | |
| 6,437,750 | B1 | 8/2002 | Grimes et al. | |
| 6,512,488 | B2 | 1/2003 | Schantz | |
| 6,515,633 | B2 * | 2/2003 | Ippolito | 343/797 |
| 6,525,696 | B2 * | 2/2003 | Powell et al. | 343/770 |
| 6,593,886 | B2 | 7/2003 | Schantz | |
| 6,621,462 | B2 * | 9/2003 | Barnes | 343/787 |
| 6,642,903 | B2 | 11/2003 | Schantz | |
| 6,842,141 | B2 | 1/2005 | Suh et al. | |
| 6,845,253 | B1 | 1/2005 | Schantz | |
| 2003/0210207 | A1 | 11/2003 | Suh | |
| 2004/0239562 | A1 | 12/2004 | Schantz | |
| 2005/0152264 | A1 * | 7/2005 | Siwiak | 370/206 |

OTHER PUBLICATIONS

"Three New Antenna Types and Their Applications" by Armig Kandoian, Proc. IRE, Feb. 1946, pp. 70W-75W.

"Physical Limitations of Omni-Directional Antennas" by L.J. Chu, Journal of Applied Physics, 19, 1948, pp. 1163-1175.

Antennas and Waveguides for Nonsinusoidal Waves by Henning Harmuth, Orlando, FL: Academic Press, 1984, pp. 98-99.

Antennas, 2nd ed., by John Kraus, New York: McGraw Hill, 1988, p. 264, Problem 6-9; pp. 731-732.

"The Energy Flow and Frequency Spectrum About Electric and Magnetic Dipoles" by Hans Schantz, Ph.D. Dissertation, The University of Texas at Austin, Aug. 1995, pp. 51-52.

* cited by examiner

BROADBAND ELECTRIC-MAGNETIC ANTENNA APPARATUS AND METHOD

This application claims benefit of prior filed co-pending Provisional Patent Application Ser. No. 60/538,187 filed Jan. 22, 2004.

BACKGROUND OF THE INVENTION

1. Field of the Invention

The present invention relates to antennas and more specifically to an apparatus and system to combine broadband electric and magnetic antennas so as to create a highly efficient electrically small broadband antenna.

2. Description of the Prior Art

Broadband antenna systems are in great demand for precision tracking, radar, and communications. A commercially successful UWB antenna system must be both small and efficient. Additionally, it is advantageous for a UWB antenna to radiate and receive signals with polarization diversity.

In related art, Chu, Kraus, and Schantz have considered the theoretical advantages of an electric-magnetic antenna system in which fields from an electric element are arranged ninety degrees out of phase with respect to fields from a magnetic antenna element, i.e. fields in quadrature. Chu argues that such a composite antenna could be made half the size of a standard small element electric or magnetic antenna [L. J. Chu, "Physical Limitations of Omni-Directional Antennas," Journal of Applied Physics, 19, 1948, pp. 1163–1175]. Kraus observed that feeding orthogonal loop and dipole elements leads to quadrature signals [John Kraus, *Antennas,* $2^{nd}$ ed. New York: McGraw Hill, 1988, p. 264, Problem 6–9]. Also, the inventor has elsewhere observed that there is a beneficial cancellation of near field components around co-located ideal Hertzian electric and magnetic point dipoles [Hans Gregory Schantz, "The Energy Flow and Frequency Spectrum About Electric and Magnetic Dipoles," Ph.D. Dissertation, The University of Texas at Austin, August 1995, pp. 51–52]. This cancellation results in a fixed, net radial outward energy flow about the antenna. In principle, this should lead to a significantly smaller antenna with less troublesome near field reactive energy than could be achieved by a standard small element electric or magnetic antenna.

In other art, Barnes et al teach a UWB chiral system involving relative delays between signals to or from a pair of orthogonal antennas [U.S. Pat. No. 5,764,696]. This art does not address methods other than a delay for achieving quadrature signals, nor does this art teach how to achieve a substantially omni-direction chiral-polarized transmission or reception.

To achieve a broadband electric-magnetic antenna system requires a superposition of both a broadband electric element and a broadband magnetic element. First, this section will address broadband electric antennas. Second, this section will address broadband magnetic antennas. Finally, this section will examine antenna systems comprising superpositions of electric and magnetic antenna elements.

Broadband Electric Antennas

A wide variety of broadband electric antenna elements have been proposed. This section will survey the most relevant and applicable. Walter Stöhr introduced solid, surface-of-revolution spheroidal and ellipsoidal broadband antenna elements [U.S. Pat. No. 3,364,491]. Farzin Lalezari et al devised a semi-circular dipole or dual notch antenna element [U.S. Pat. No. 4,843,403]. Mike Thomas et al proposed planar cross-sections of spheroidal dipoles or planar circle dipole elements [U.S. Pat. No. 5,319,377]. Taisuke Ihara et al suggested multiple plate semi-circular arc elements [U.S. Pat. No. 5,872,546]. In other art, the present inventor introduced a variety of broadband dipole designs [U.S. Pat. No. 6,845,253] as well as planar elliptical dipole antennas fed from a coplanar taper microstrip balun [U.S. Pat. No. 6,512,488; U.S. Pat. No. 6,642,903].

Broadband Magnetic Antennas

A wide variety of broadband magnetic antennas have been proposed. For instance, Barnes taught a tapered broadband magnetic slot antenna [U.S. Pat. No. 6,091,374; U.S. Pat. No. 6,400,329; U.S. Pat. No. 6,621,462]. Such antennas can achieve broadband performance, but do not yield omni-directional performance. The inventor suggested a planar loop antenna [U.S. Pat. No. 6,593,886], but this planar loop antenna has a dispersive pattern resulting from the relative delays introduced to signals transmitted or received at different angles.

Harmuth suggested using cloverleaf loop antennas to ensure a uniform delay and non-dispersive omni-directional wave front [Henning Harmuth, *Antennas and Waveguides for Nonsinusoidal Waves*, Orlando, Fla.: Academic Press, 1984, pp. 98–99]. Cloverleaf loop antennas have long been appreciated by antenna designers for their ability to achieve a distributed loop or magnetic dipole type response with uniform phase behavior around the periphery of the loop [John Kraus, *Antennas,* $2^{nd}$ ed., New York: McGraw Hill, 1988, pp. 731–732]. Harmuth further taught that additional shielding was necessary to prevent a superposition of signals from a near and a far side of the cloverleaf loop antenna. Harmuth also failed to disclose how to implement a well matched broadband cloverleaf loop antenna with acceptable performance.

Electric-Magnetic Antennas

A wide variety of composite electric-magnetic antennas have been proposed. One early design was the superposition of a dipole antenna along the axis of a loop antenna disclosed by Runge [U.S. Pat. No. 1,892,221]. Runge's polarization diversity receiver allows the detection of a signal with any polarity at a particular frequency, but because the phase difference between the two elements depends upon a quarter wavelength difference in the length of a transmission line, it achieves the desired effect of a 90° phase shift only at a particular frequency.

Luck [U.S. Pat. No. 2,256,619] and Busignies [U.S. Pat. No. 2,282,030] both proposed various superpositions of loop and dipoles antennas. Additionally, Kandoian proposed an "electric-magnetic antenna" that could operate over relatively narrow bandwidths [U.S. Pat. No. 2,465,379]. Kandoian further addressed the performance of his electric-magnetic antenna system elsewhere [Kandoian, "Three New Antenna Types and Their Applications," Proc. IRE, February 1946, pp. 70W–75W].

Kibler proposed a similar antenna system [U.S. Pat. No. 2,460,260]. Since that time a great many inventors have proposed to superimpose electric and magnetic antenna elements. These superpositions have achieved antenna loading, directionality, polarization diversity, and other goals. None of this prior art addresses the challenging problem of creating an antenna system that can create a quadrature field configuration over a broadband range of frequencies.

In view of the foregoing, there is a need for a compact planar broadband loop antenna that can provide an omni-direction horizontally polarized signal. Similarly, there is a need for a compact, readily manufactured planar electric broadband antenna. There is a further need for smaller, more efficient broadband antennas than are currently available with electric only or magnetic only small element antennas. There is also a need for an antenna with minimal stored reactive energy and thus maximal bandwidth. There is a further need for an antenna with minimal reactive energy and thus minimal undesired coupling with a surrounding environment within which the antenna is embedded.

SUMMARY OF THE INVENTION

Accordingly, an object of the present invention is to provide a compact broadband electric dipole antenna. Also, it is an object of the present invention to provide a compact planar broadband loop antenna that can yield an omni-directional horizontally polarized signal. It is a further object of the present invention to describe a smaller, more efficient broadband antenna than those currently available with electric only or magnetic only small element antennas. Yet another object of the present invention is to provide an antenna with minimal stored reactive energy and thus maximal bandwidth. An additional object of the present invention is to provide an antenna with minimal reactive energy and thus minimal undesired coupling with a surrounding environment within which the antenna is embedded. These objects and more are met by the present invention: a Broadband Electric-Magnetic Antenna Apparatus and System.

The present invention teaches a broadband electric dipole apparatus comprising a first element and a second element where a first element is either an elliptically tapered semi-circular element or an equipotential tapered element. A broadband antenna may further comprise a backplane. Additionally the present invention teaches a broadband antenna apparatus comprising a first element, a second element, and a backplane wherein the first and second antenna elements include a plurality of sections substantially co-planar with a backplane and wherein a first element is electrically coupled to a backplane. Further, a second element may also be electrically coupled to a backplane.

The present invention further teaches a first broadband magnetic antenna apparatus comprising N lobes wherein said lobes are substantially planar and wherein $N \geqq 2$. A broadband magnetic antenna apparatus may further comprise an offset feed, a serrated edge, or a second broadband magnetic antenna apparatus substantially orthogonal to a first broadband magnetic antenna apparatus.

The present invention also discloses a broadband electric-magnetic antenna apparatus comprising a broadband electric antenna element and a broadband magnetic antenna element. A broadband electric-magnetic antenna apparatus may further comprise a quadrature phase shifter. In addition, a broadband electric-magnetic antenna apparatus may further comprise a plurality of quadrature notches including possibly two, three, four, five, or some other number of quadrature notches. A broadband electric-magnetic antenna apparatus may include a broadband magnetic antenna element comprising N lobes wherein said lobes are substantially planar and wherein $N \geqq 2$. In addition, the present invention teaches a polarization diverse antenna apparatus comprising two or more quadratures notches.

Furthermore, the present invention teaches a broadband chiral polarized transmitter system comprising a means for generating broadband quadrature signals; and antenna means for radiating polarization diverse signals. A means for generating broadband quadrature signals may include a means for generating in phase and quadrature carrier signals, mixing means, and a means for generating baseband waveforms. Antenna means for radiating polarization diverse signals may comprise an electric-magnetic antenna system as disclosed by the present invention.

Finally, the present invention suggests a broadband chiral polarized receiver system comprising antenna means for receiving polarization diverse signals and means for receiving broadband quadrature signals. Antenna means for radiating polarization diverse signals may comprise an electric-magnetic antenna system as disclosed by the present invention. Means for receiving broadband quadrature signals may further comprise reception means for a first antenna signal, reception means for a second antenna signal, means for generating in phase and quadrature carrier signals, mixing means, and demodulation means.

With these and other objects, advantages, and features of the invention that may become hereinafter apparent, the nature of the invention may be more clearly understood by reference to the detailed description of the invention, the appended claims and to the several drawings herein.

DETAILED DESCRIPTION OF THE PREFERRED EMBODIMENT

Overview of the Invention

The present invention is directed to a broadband electric-magnetic antenna apparatus and method. The present invention teaches a variety of electric antennas suitable for use in the present invention as well as a variety of magnetic antennas suitable for use in the present invention. Combination of a broadband electric antenna element and a broadband magnetic element to create a broadband electric-magnetic antenna system is discussed. This invention further teaches systems for using a broadband electric magnetic antenna system to radiate or receive quadrature signals.

The demands of modern communication and wireless networks place an ever increasing burden on broadband antennas to be small, efficient, and polarization diverse. Small, efficient, and polarization diverse antennas are certainly advantageous for narrow band systems as well, particularly for narrow band systems that operate at a wide variety of discrete frequencies. Broadband antennas are those that operate over fractional bandwidths on the order of 10% or (preferably) more. Ultra-wideband or UWB systems are a subset of broadband systems with even larger bandwidths. Thus, although sometimes discussion may refer to UWB antennas and systems, or sometimes to broadband antennas and systems, the UWB, broadband, and narrow band worlds all face similar challenges and could benefit from advances in broadband antenna design taught by the present invention.

The present invention will now be described more fully in detail with reference to the accompanying drawings, in which the preferred embodiments of the invention are shown. This invention should not, however, be construed as limited to the embodiments set forth herein; rather, they are provided so that this application will be thorough and complete and will fully convey the scope of the invention to those skilled in the art. Like numbers refer to like elements throughout.

Broadband Electric Antenna Elements

Figure 1:
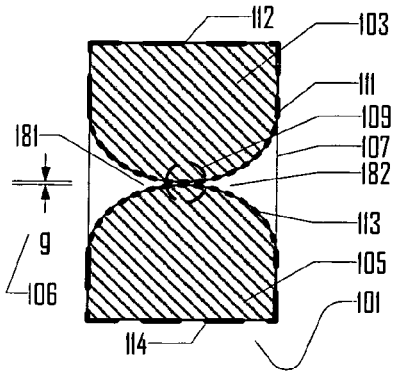
FIG. 1 is a schematic diagram of a planar dipole with elliptically tapered semi-circular elements.

FIG. 1 is a schematic diagram of a planar dipole with elliptically tapered semi-circular elements 101. Planar dipole 101 is a broadband electric dipole apparatus. Planar dipole 101 comprises first elliptically tapered semi-circular element 103, second elliptically tapered semi-circular element 105, and optional dielectric substrate 107. First elliptically tapered semi-circular element 103 is characterized by first elliptical taper 111. Similarly, second elliptically tapered semi-circular element 105 is characterized by second elliptical taper 113.

First elliptical taper 111 and second elliptical taper 113 cooperate to form a variable tapered slot with a feed region 109. Planar dipole 101 is a dual notch electric element antenna. First elliptical taper 111 and second elliptical taper 113 cooperate to form a first notch 181 and a second notch 182. A first notch 181 and a second notch 182 couple in parallel with respect to feed region 109. For instance, if a first notch 181 and a second notch 182 each present a 100 ohm impedance to feed region 109, feed region 109 perceives a 50 ohm impedance load.

First semi-circular element 103 and second semi-circular element 105 are substantially rectangular on first distal edge 112 and second distal edge 114, respectively. First distal edge 112 and second distal edge 114 are distal with respect to feed region 109.

Unlike the semi-circular or parabolic tapers taught in the prior art (for instance in U.S. Pat. No. 4,843,403), with appropriate choice of gap 106, first elliptical taper 111 and second elliptical taper 113 cooperate to yield an excellent broadband match to impedances in the vicinity of 50 ohms.

Unlike the elliptical tapered elements taught in certain prior art (for instance in U.S. Pat. No. 6,512,488; U.S. Pat. No. 6,642,903; U.S. Pat. No. 6,845,253), first elliptically tapered semi-circular element 103, and second elliptically tapered semi-circular element 105 have longer perimeters and can yield a lower operational frequency (or equivalently a more compact size) than comparable elliptical tapered elements.

Although broadband electric dipole apparatus dipole 101 is a planar dipole, in alternate embodiments, broadband electric dipole apparatus dipole 101 may comprise a plurality of surface-of-revolution elements with a cross section substantially similar to an outline of elliptically tapered semi-circular element 103.

Figure 2:
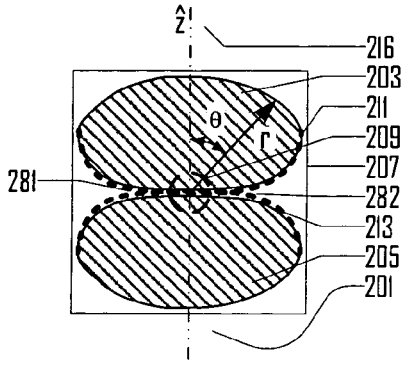
FIG. 2 is a schematic diagram of a planar dipole with equipotential shaped elements.

FIG. 2 is a schematic diagram of a planar dipole with equipotential shaped elements 201. Planar dipole 201 is a broadband electric dipole antenna apparatus. Planar dipole 201 comprises first equipotential tapered element 203, second equipotential tapered element 205, and optional dielectric substrate 207. First equipotential tapered element 203 is characterized by first equipotential taper 211. Similarly, second equipotential tapered element 205 is characterized by second equipotential taper 213.

First equipotential taper 211 and second equipotential taper 213 cooperate to form a variable tapered slot with a feed region 209. Planar dipole 201 is a dual notch electric element antenna. First equipotential taper 213 and second equipotential taper 213 cooperate to form a first notch 281 and a second notch 282. A first notch 281 and a second notch 282 couple in parallel with respect to feed region 209. For instance, if a first notch 281 and a second notch 282 each present a 100 ohm impedance to feed region 209, feed region 209 perceives a 50 ohm impedance load.

A static ideal Hertzian electric dipole aligned with z-axis 216 is characterized by an electric potential:

$$\Phi = -\frac{\cos\theta}{r^2} \tag{1}$$

where r is the radial coordinate, and θ is the angle with respect to the z-axis. A static ideal Hertzian electric dipole aligned with z-axis 216 is thus characterized by an equipotentials given by:

$$r = K\sqrt{\cos\theta} \tag{2}$$

where K is a constant. An equipotential shaped (or equivalently an equipotential tapered) element is one substantially defined by the equipotential relation (Eq. 2).

Unlike the elliptical tapered elements taught in certain prior art (for instance in U.S. Pat. No. 6,512,488; U.S. Pat. No. 6,642,903; U.S. Pat. No. 6,845,253), equipotential tapered elements (like first equipotential element 203 and second equipotential element 205) yield a closer match to the energy flow streamlines around an ideal electric dipole. Thus, equipotential tapered elements (like first equipotential element 203 and second equipotential element 205) yield a better match and more optimal dipole performance than comparable elliptical tapered elements.

Although broadband electric dipole apparatus dipole 201 is a planar dipole, in alternate embodiments, broadband electric dipole apparatus dipole 201 may comprise a plurality of surface-of-revolution elements with a cross section substantially similar to an outline of equipotential element 203.

Figure 3:
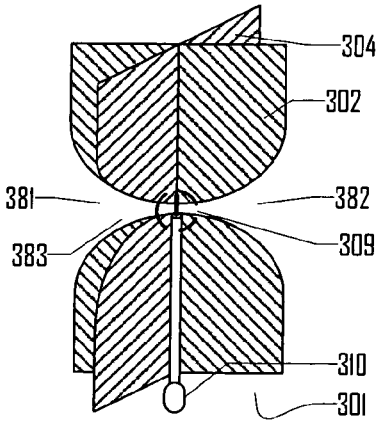
FIG. 3 is a schematic diagram of a multiple plate dipole with elliptically tapered semi-circular elements.

FIG. 3 is a schematic diagram of a multiple plate dipole with elliptically tapered semi-circular elements 301. Multiple plate dipole 301 comprises a substantially orthogonal superposition of a first planar dipole with elliptically tapered semi-circular elements 304 and a second planar dipole with elliptically tapered semi-circular elements 302.

Multiple plate dipole 301 is a four notch electric element antenna with a first notch 381, a second notch 382, a third notch 383, and a fourth notch not readily visible in FIG. 3. First notch 381, second notch 382, third notch 383, and a fourth notch couple in parallel with respect to feed region 309. For instance, if a first notch 381, second notch 382, third notch 383, and a fourth notch each present a 200 ohm impedance to feed region 309, feed region 309 perceives a 50 ohm impedance load.

First planar dipole 304 and second planar dipole 303 share a common feed region 309. Coaxial feed line 310 couples into feed region 309. First planar dipole 304 and second planar dipole 303 comprise conducting elements and do not include dielectric substrates. In alternate embodiments, first planar dipole 304 and second planar dipole 303 may further comprise dielectric substrates.

Figure 4:
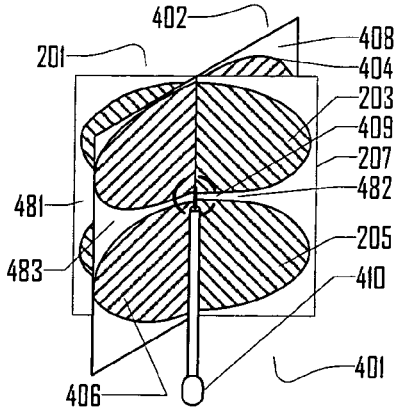
FIG. 4 is a schematic diagram of a multiple plate dipole with equipotential shaped elements.

FIG. 4 is a schematic diagram of a multiple plate dipole with equipotential shaped elements 401. Multiple plate dipole 401 comprises a substantially orthogonal superposition of a first planar dipole with equipotential shaped elements 201 and a second planar dipole with equipotential shaped elements 402. First planar dipole 201 and second planar dipole 402 share a common feed region 409. Coaxial feed line 410 couples into feed region 409. In alternate embodiments, an alternate feed line such as a microstrip, stripline, or co-planar waveguide may couple into feed region 409.

Multiple plate dipole 401 is a four notch electric element antenna with a first notch 481, a second notch 482, a third notch 483, and a fourth notch not readily visible in FIG. 4. First notch 481, second notch 482, third notch 483, and a fourth notch couple in parallel with respect to feed region 409. For instance, if a first notch 481, second notch 482, third notch 483, and a fourth notch each present a 200 ohm impedance to feed region 409, feed region 409 perceives a 50 ohm impedance load.

Multiple plate dipoles with even numbers of notches (like multiple plate dipole 401) tend to be easier to construct. However multiple plate dipoles may include odd numbers of notches in alternate embodiments or even numbers of notches greater than four. In general, increasing number of notches yields a more uniform pattern and subject to diminishing returns and greater complexity with additional notches. Also notches are easiest to design with impedances on the order of 100 ohms to 200 ohms, so two to four such notches yield good matches to the 50 ohms typical of RF devices. One skilled in the RF arts realizes that impedances other than 50 ohms may be desirable and can be readily achieved.

Planar dipole 201 comprises first equipotential element 203, second equipotential element 205, and optional dielectric substrate 207. Similarly, second planar dipole with equipotential shaped elements 402 comprises first equipotential element 404, second equipotential element 406, and optional dielectric substrate 408.

Figure 5:
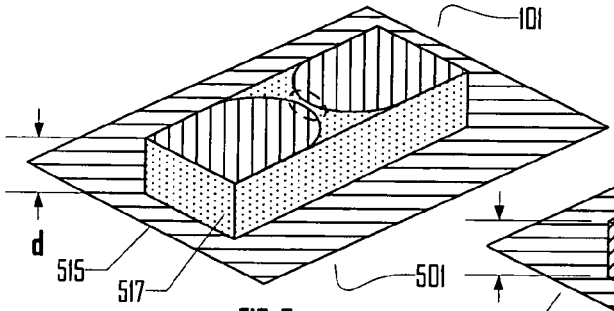
FIG. 5 is a schematic diagram of a reflector antenna system.

FIG. 5 is a schematic diagram of a broadband reflector antenna system 501. Broadband reflector antenna system 501 comprises planar dipole 101 with elliptically tapered semi-circular elements, a backplane 515, and an optional dielectric 517. Planar dipole 101 is substantially co-planar with backplane 515 and separated by a spacing d. Spacing d is typically between 0.1 $\lambda$ and 0.3 $\lambda$ where $\lambda$ is the wavelength at a frequency of interest, such as the center frequency of a relevant broadband signal.

Figure 6:
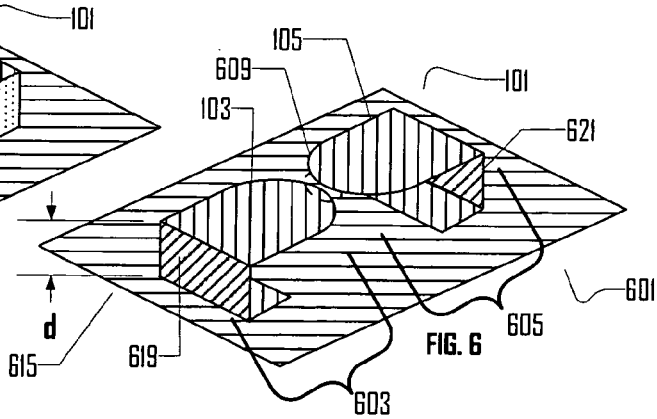
FIG. 6 is a schematic diagram of a backplane coupled reflector antenna system.

FIG. 6 is a schematic diagram of a backplane coupled reflector antenna system 601. Backplane coupled reflector antenna system 601 comprises planar dipole 101 with elliptically tapered semi-circular elements, a backplane 515, a first coupling means 619, and an optional second coupling means 621. Planar dipole 101 further comprises first elliptically tapered semi-circular element 103, and second elliptically tapered semi-circular element 105.

Alternatively, backplane coupled reflector antenna system 601 may be thought of as comprising first element 603, second element 605, backplane 515 and feed region 609. First element 603 comprises first elliptically tapered semi-circular element 103 and first coupling means 619. First elliptically tapered semi-circular element 103 is substantially co-planar with backplane 515. Similarly, second element 605 comprises second elliptically tapered semi-circular element 105 and second (optional) coupling means 621.

First elliptically tapered semi-circular element 103 is separated by a spacing d from backplane 515. Spacing d is typically between 0.1 $\lambda$ and 0.3 $\lambda$ where $\lambda$ is the wavelength at a frequency of interest, such as the center frequency of a relevant broadband signal.

First elliptically tapered semi-circular element 103 is electrically coupled to first coupling means 619. Electrical coupling may include direct attachment (for instance by soldering), capacitive coupling, or first elliptically tapered semi-circular element 103 and first coupling means 619 may form one continuous conducting surface. In alternate embodiments, first elliptically tapered semi-circular element 103 and first coupling means 619 may further comprise a dielectric substrate, particularly a flexible dielectric substrate with a gradual curve between a portion of a dielectric substrate's metallization serving as a first elliptically tapered semi-circular element 103 and a portion of a dielectric substrate's metallization serving as a first coupling means 619. First coupling means 619 is electrically coupled to back plane 515. Electrical coupling may include direct attachment (for instance by soldering), or capacitive coupling (for instance by mechanically placing a substantial area of first coupling means 619 in close proximity to back plane 515).

Feed region 609 couples to a feed line such as a coaxial line or to an alternate feed line such as a micro-strip, stripline, or co-planar waveguide. First coupling means 619 provides a potential routing for a feed line. If feed region 609 and first coupling means 619 share a common flexible dielectric, a feed line may be embedded in a flexible dielectric.

In alternate embodiments, second elliptically tapered semi-circular element 105 may be similarly electrically coupled to optional second coupling means 621, and second coupling means 621 may be similarly electrically coupled to back plane 515.

Broadband Magnetic Antenna Elements

Figure 7:
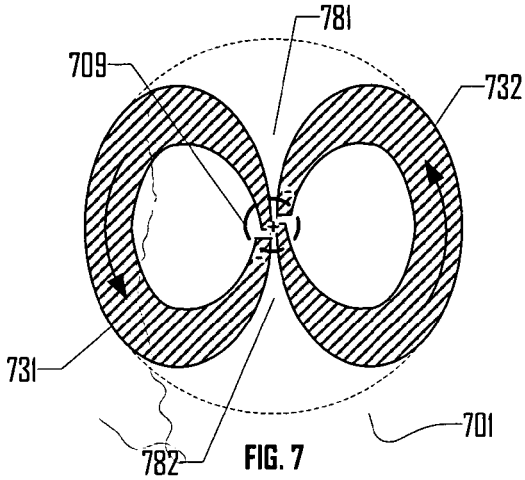
FIG. 7 is a schematic diagram of a figure eight or two lobed planar loop antenna.

FIG. 7 is a schematic diagram of a figure eight or two lobed planar loop antenna 701. Two lobed planar loop antenna 701 is a broadband magnetic antenna apparatus comprising first lobe 731, second lobe 732, and feed region 709. First lobe 731, and second lobe 732 are generally symmetric and substantially planar. In alternate embodiments, lobes may be bulbous rather than planar. Feed region 709 couples to first lobe 731, and second lobe 732 in such a fashion as to ensure a common orientation of current circulation in two lobed planar loop antenna 701. In one exemplary feed configuration, feed region 709 may couple to a common "+" terminal and two "−" terminals so as to yield a current configuration with a common counter-clockwise current configuration as shown in FIG. 7. Symbols like "+" and "−" are employed in the figures of the present disclosure to assist a reader in understanding a potential mode of operation of the present invention and should not be construed as limiting alternate modes of operation.

Two lobed planar loop antenna 701 is a dual notch magnetic element antenna. First lobe 731 and second lobe 732 cooperate to form first notch 781 and second notch 782. Two lobed planar loop antenna 701 offers a more uniform current distribution, less dispersive response, and more omni-directional radiation pattern than a comparable single lobed planar loop antenna (such as prior art planar loop antennas as taught in U.S. Pat. No. 6,593,886).

Figure 8:
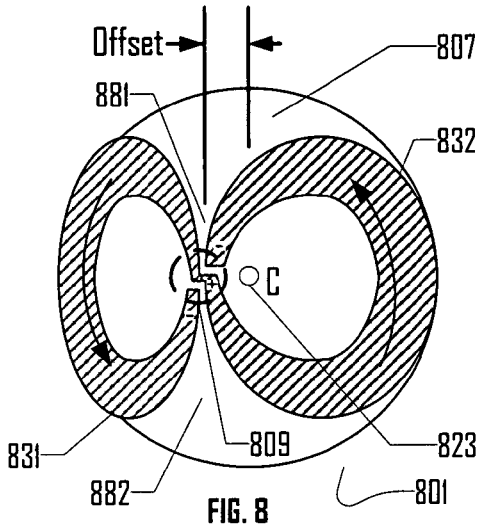
FIG. 8 is a schematic diagram of a figure eight or two lobed planar loop antenna with an offset feed.

FIG. 8 is a schematic diagram of a figure eight or two lobed planar loop antenna 801 with an offset feed. Offset fed two lobed planar loop antenna 801 is a broadband magnetic antenna apparatus comprising first lobe 831, second lobe 832, optional dielectric substrate 807 and feed region 809. First lobe 831, and second lobe 832 are asymmetric so as to induce an offset in feed region 809 with respect to a centroid 823. A modest offset will not significantly alter a desired current balance in first lobe 831, and second lobe 832, yet will enable offset fed two lobed planar loop antenna 801 to have a feed region 809 substantially co-located with the feed region of a different antenna. The feed offset taught by the present disclosure and exemplified in offset fed two lobed planar loop antenna 801 may be advantageously applied to other antennas as well.

Feed region 809 couples to first lobe 831, and second lobe 832 in such a fashion as to ensure a common orientation of current circulation in two lobed offset fed planar loop antenna 801. In one exemplary feed configuration, feed region 809 may couple to a common "+" terminal and two "−" terminals so as to yield a current configuration with a common counter-clockwise current configuration as shown in FIG. 8.

Two lobed offset fed planar loop antenna 801 is also a dual notch magnetic element antenna. First lobe 831 and second lobe 832 cooperate to form first notch 881 and second notch 882.

Planar loop antennas with two lobes (such as two lobed planar loop antenna 701 or two lobed offset fed planar loop antenna 801) are well suited for superposition with two notch plate electric dipole antennas (such as a planar dipole with elliptically tapered semi-circular elements 101, or a planar dipole with equipotential shaped elements 201).

Figure 9:
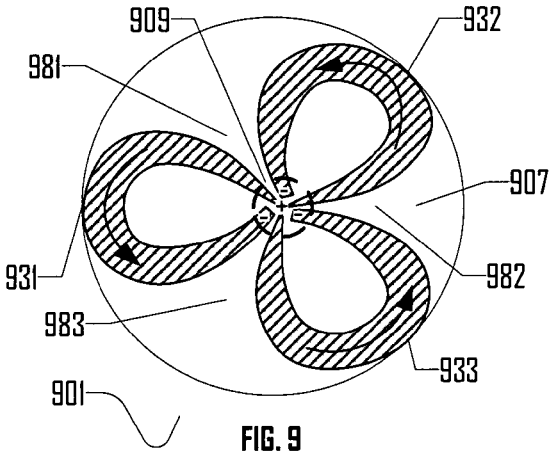
FIG. 9 is a schematic diagram of a three lobed planar loop antenna.

FIG. 9 is a schematic diagram of a three lobed planar loop antenna 901. Three lobed planar loop antenna 901 is a broadband magnetic antenna apparatus comprising first lobe 931, second lobe 932, third lobe 933, dielectric substrate 907, and feed region 909.

Feed region 909 couples to first lobe 931, second lobe 932, and third lobe 933 in such a fashion as to ensure a common orientation of current circulation in three lobed planar loop antenna 901. In one exemplary feed configuration, feed region 909 may couple to a common "+" terminal and three "−" terminals so as to yield a current configuration with a common counter-clockwise current configuration as shown in FIG. 9.

Three lobed planar loop antenna 901 is a three notch magnetic element antenna. First lobe 931, second lobe 932, and third lobe 933 cooperate to form first notch 981, second notch 982, and third notch 983. Three lobed planar loop antenna 901 offers a more uniform, less dispersive, and more omni-directional radiation pattern than a comparable two lobed planar loop antenna 701, at the cost of additional complexity.

Figure 10:
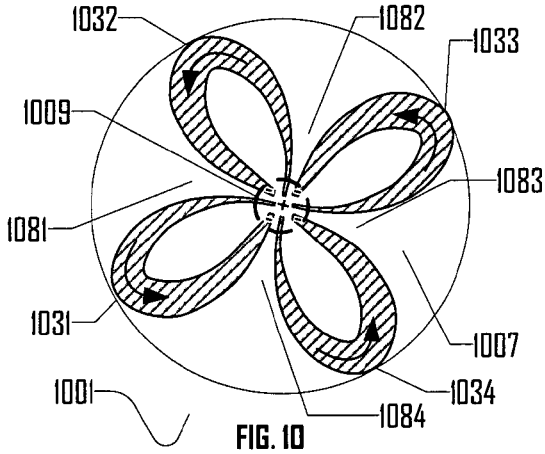
FIG. 10 is a schematic diagram of a four lobed planar loop antenna.

FIG. 10 is a schematic diagram of a four lobed planar loop antenna 1001. Four lobed planar loop antenna 1001 comprises first lobe 1031, second lobe 1032, third lobe 1033, fourth lobe 1034, dielectric substrate 1007, and feed region 1009.

Feed region 1009 couples to first lobe 1031, second lobe 1032, third lobe 1033, and fourth lobe 1034 in such a fashion as to ensure a common orientation of current circulation in four lobed planar loop antenna 1001. In one exemplary feed configuration, feed region 1009 may couple to a common "+" terminal and four "−" terminals so as to yield a current configuration with a common counter-clockwise current configuration as shown in FIG. 10.

Four lobed planar loop antenna 1001 may be thought of as a planar broadband clover leaf antenna. Contrary to prior art discussions of broadband clover leaf antennas that teach such antennas require shielding of one side, the inventor has discovered that signals from opposite sides of four lobed planar loop antenna 1001 add up coherently and non-dispersively. Novel four lobed planar loop antenna 1001 offers excellent broadband performance.

Four lobed planar loop antenna 1001 is a four notch magnetic element antenna. First lobe 1031, second lobe 1032, third lobe 1033 and fourth lobe 1034 cooperate to form first notch 1081, second notch 1082, third notch 1083, and fourth notch 1084. Four lobed planar loop antenna 1001 offers a more uniform, less dispersive, and more omni-directional radiation pattern than a comparable three lobed planar loop antenna 901, at the cost of additional complexity. The teachings of the present invention similarly apply to planar loop antennas with five, six, seven, or more lobes. However, there will come a point of diminishing returns where the additional complexity is not justified by the incremental improvement in performance. Further, with a large number of lobes, there may not be sufficient arc width for a notch to support an adequate taper to achieve a good impedance match. The inventor has discovered that planar loop antennas with three or four lobes offer a good comprise between performance and complexity.

Planar loop antennas with four lobes or equivalently with four notches (such as four lobed planar loop antenna 1001) are well suited for superposition with four notch electric dipole antennas (such as multiple plate dipole with elliptically tapered semi-circular elements 301 or multiple plate dipole with equipotential sheped elements 401).

Figure 11:
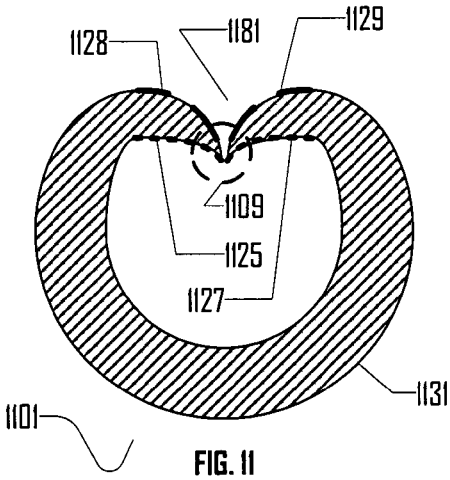
FIG. 11 is a schematic diagram of a planar loop antenna with an asymmetric slot feed.

FIG. 11 is a schematic diagram of a planar loop antenna 1101 with an asymmetric slot feed. Asymmetric slot fed planar loop antenna 1101 comprises a single lobe loop element 1131 and a feed region 1109. First outer edge 1128 and second outer edge 1129 (denoted by long black dashes) are closely spaced and cooperate to form a low impedance slot line (for instance, but not necessarily 50 ohms with respect to feed region 1109). First inner edge 1125 and second inner edge 1127 (denoted by short dashes) are more distantly spaced and cooperate to form a high impedance slot line.

Thus, first outer edge 1128, second outer edge 1129, first inner edge 1125, and second inner edge 1127 cooperate to direct currents preferentially toward first outer edge 1128 and second outer edge 1129 and cooperate to direct currents preferentially away from first inner edge 1125, and second inner edge 1127.

First outer edge 1128 and second outer edge 1129 (denoted by long black dashes) are preferentially elliptically tapered so as to enable a well matched and efficient asymmetric slot fed planar loop antenna 1101. Alternatively first outer edge 1128 and second outer edge 1129 (denoted by long black dashes) are tapered so as to create a desired impedance match.

The asymmetric slot feeding and slot tapering technique implemented in single lobed asymmetric slot fed planar loop antenna 1101 may also be applied to planar loop antennas with more than a single lobe or to other embodiments of the present invention.

Figure 12:
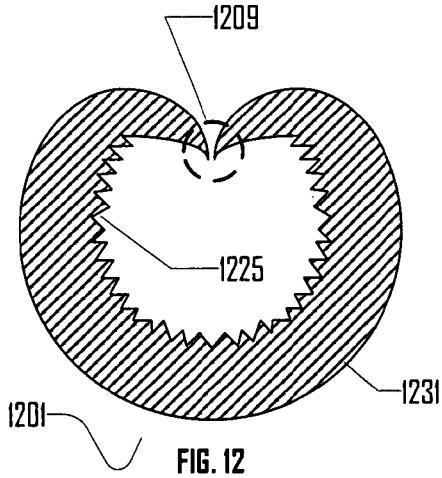
FIG. 12 is a schematic diagram of a planar loop antenna with an asymmetric slot feed and a serrated interior edge.

FIG. 12 is a schematic diagram of a planar loop antenna 1201 with an asymmetric slot feed and a serrated interior edge. Asymmetric fed, serrated interior planar loop antenna 1201 comprises and a feed region 1209 and a single lobe loop element 1231 with serrated interior 1225. Serrated interior 1225 acts so as to create a high impedance that preferentially directs currents away from serrated interior 1225. The serrated interior technique implemented in single lobed asymmetric fed, serrated interior planar loop antenna 1201 may also be applied to planar loop antennas with more than a single lobe.

Figure 13:
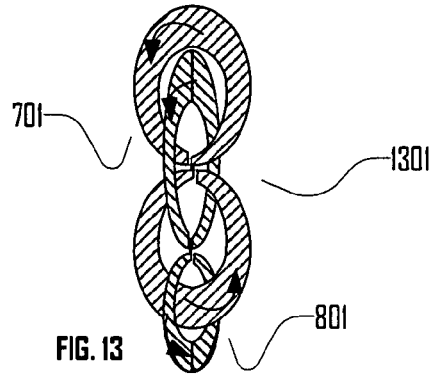
FIG. 13 is a schematic diagram illustrating a dual loop antenna system.

FIG. 13 is a schematic diagram illustrating a dual loop antenna system 1301. Dual loop antenna system 1301 comprises two lobed planar loop antenna 701 and two lobed offset fed planar loop antenna 801 in a substantially orthogonal superposition. Dual loop antenna system 1301 is also well-suited for use in conjunction with applicant's co-pending "System and Method for Ascertaining Angle of Arrival of an Electromagnetic Signal" [2004/0239562 A1].

Preferred embodiments of the present invention show coupling to "+" and "−" terminals so as to yield a current configuration with a common current configuration either clockwise or counter-clockwise. In alternate embodiments, multi-lobed (two or more lobes) planar loops may advantageously employ counter rotating currents (i.e. clockwise in one or more lobes, counter-clockwise in one or more other lobes). Counter-rotating currents yield phase reversals in antenna patterns across the azimuthal plane. This alternate embodiment is also useful in conjunction with applicant's co-pending "System and Method for Ascertaining Angle of Arrival of an Electromagnetic Signal" [2004/0239562 A1].

Broadband Electric-Magnetic Antenna Apparatus

Figure 14:
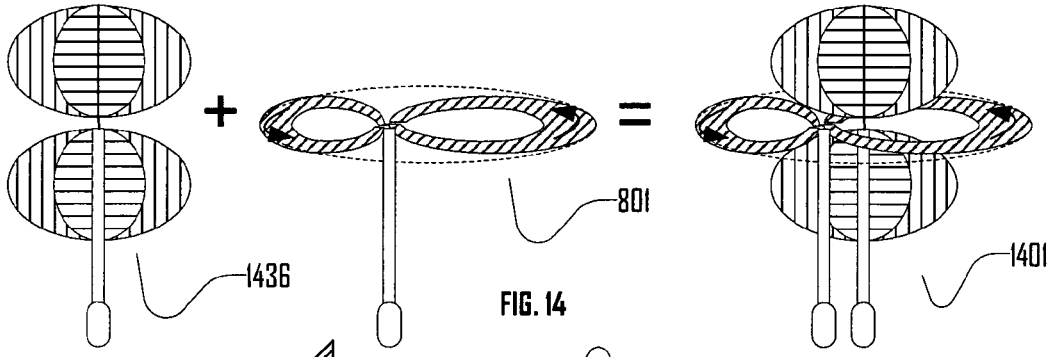
FIG. 14 is a schematic diagram illustrating the superposition of an electric element and a magnetic element to form an electric-magnetic broadband antenna.

FIG. 14 is a schematic diagram illustrating the superposition of an electric element 1436 and a magnetic element 801 to form a broadband electric-magnetic antenna apparatus 1401. A wide variety of broadband electric antennas are suitable for use in conjunction with a planar loop antenna as taught herein. One possible choice is a broadband ellipsoidal dipole such as was taught by Stöhr [U.S. Pat. No. 3,364,491]. Rather than the solid ellipsoidal elements employed by Stöhr, electric element 1436 is an ellipsoidal structure composed of a hexagonal arrangement of elliptical plates. Thus, electric element 1436 is a six notch electric element. This ellipsoidal structure composed of a hexagonal arrangement of elliptical plates is functionally equivalent to a solid ellipsoid as taught by Stöhr.

Broadband electric-magnetic antenna apparatus 1401 comprises six notch electric element 1436 and four notch magnetic element 801. The number of notches in an electric element (like electric element 1436) and the number of notches in a magnetic element (like magnetic element 801) do not have to be identical.

Preferred Embodiment

Figure 15:
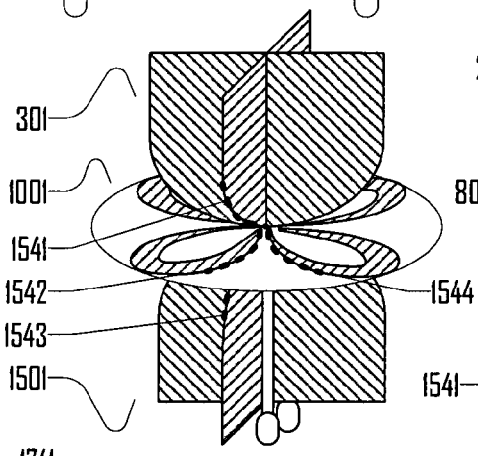
FIG. 15 is a schematic diagram of a preferred embodiment broadband electric-magnetic antenna apparatus.

FIG. 15 is a schematic diagram of a preferred embodiment broadband electric-magnetic antenna apparatus 1501. Preferred embodiment broadband electric-magnetic antenna apparatus 1501 comprises a four notch multiple plate dipole 301 with elliptically tapered semi-circular elements and a four notch planar loop antenna 1001. In preferred embodiment broadband electric-magnetic antenna apparatus 1501, the number of notches in an electric element (like electric element 301) and the number of notches in a magnetic element (like magnetic element 1001) are identical. A feed region (not visible in FIG. 15) of four notch planar loop antenna 1001 may need to be offset slightly according to the teachings of the present invention so as to effect a successful superposition.

First electric element edge 1541 and second electric element edge 1543 cooperate to form a vertical notch. First magnetic element edge 1542 and second magnetic element edge 1544 cooperate to form a horizontal notch. Terms like "vertical" and "horizontal" are used for illustrative purpose to aid the viewer in understanding FIG. 15 and not for purposes of limitation. The vertical notch of first electric element edge 1541 and second electric element edge 1543 and the horizontal notch of first magnetic element edge 1542 and second magnetic element edge 1544 are substantially co-located and orthogonal—enabling creation of quadrature fields. The superposition of the vertical notch of first electric element edge 1541 and second electric element edge 1543 and the horizontal notch of first magnetic element edge 1542 and second magnetic element edge 1544 yields a "quadrature notch." Preferred embodiment broadband electric-magnetic antenna apparatus 1501 has four such quadrature notches. Four quadrature notches allow for a relatively omni-directional pattern and minimal dispersion behavior. Preferred embodiment broadband electric-magnetic antenna apparatus 1501 is a polarization diverse antenna apparatus comprising four quadrature notches.

Alternate Embodiment

Figure 16:
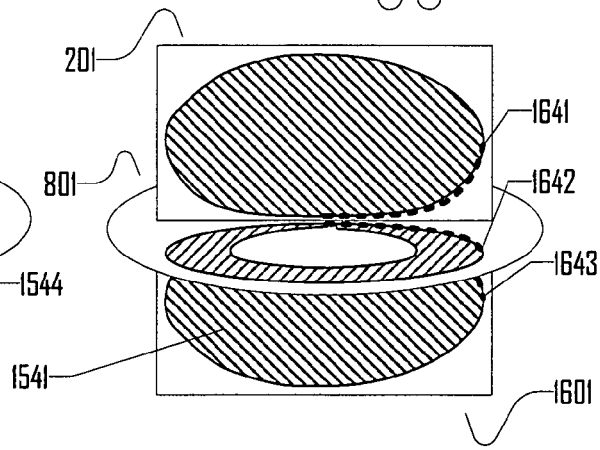
FIG. 16 is a schematic diagram of an alternate embodiment broadband electric-magnetic antenna apparatus.

FIG. 16 is a schematic diagram of an alternate embodiment broadband electric-magnetic antenna apparatus 1601. Alternate embodiment broadband electric-magnetic antenna apparatus 1601 comprises a planar dipole with equipotential tapered elements 201 and an offset fed two lobed planar loop antenna 801.

First electric element edge 1641 and second electric element edge 1643 cooperate to form a vertical notch. First magnetic element edge 1642 and second magnetic element edge (not visible in FIG. 16) cooperate to form a horizontal notch. Together, a substantially co-located, substantially orthogonal vertical notch and horizontal notch form a quadrature notch. Terms like "vertical" and "horizontal" are used for illustrative purpose to aid the viewer in understanding FIG. 16 and not for purposes of limitation. Alternate embodiment broadband electric-magnetic antenna apparatus 1601 has two quadrature notches. Two quadrature notches will not yield as omni-directional a response as an antenna apparatus comprising four quadrature notches, but may be adequate for some applications. Nevertheless, alternate embodiment broadband electric-magnetic antenna apparatus 1601 is a polarization diverse antenna apparatus comprising two quadrature notches.

Quadrature Notch

Figure 17:
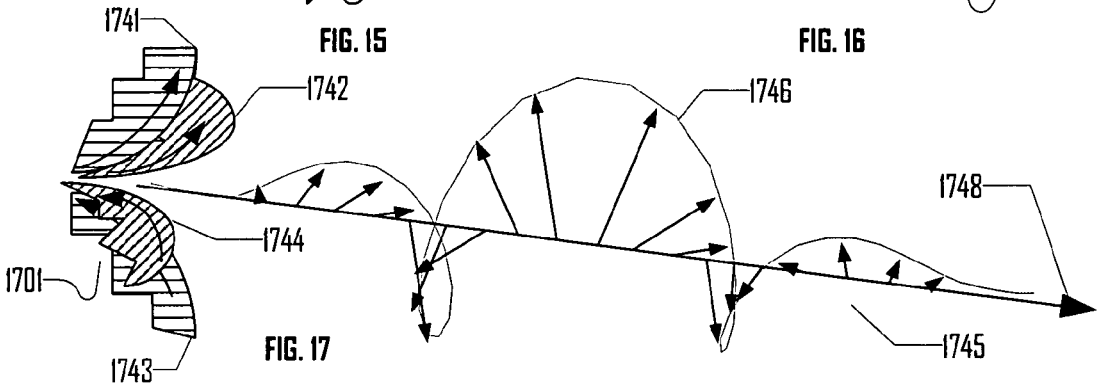
FIG. 17 is a schematic diagram illustrating details of a chiral polarization signal radiated by a quadrature notch.

FIG. 17 is a schematic diagram illustrating details of a chiral polarization signal 1745 radiated by a quadrature notch 1701. A first orthogonal planar notch antenna structure and a second orthogonal planar notch antenna structure cooperate to yield to yield a quadrature notch 1701. A first orthogonal planar notch antenna structure comprises first vertical edge 1741 and second vertical edge 1743. A second orthogonal planar notch antenna structure comprises first horizontal edge 1742 and second horizontal edge 1744. Terms like "vertical" and "horizontal" are used for illustrative purpose to aid the viewer in understanding FIG. 17 and not for purposes of limitation.

Arrows on first vertical edge 1741, second vertical edge 1743, first horizontal edge 1742, and second horizontal edge 1744 show a particular illustrative current distribution. If a first excitation on first vertical edge 1741 and second vertical edge 1743 is substantially in quadrature with respect to a second excitation on first horizontal edge 1742, and second horizontal edge 1744, quadrature notch 1701 can yield chiral polarization signal 1745. Chiral polarization signal 1745 comprises a radiated electromagnetic signal in which the orientation of an electric field 1746 corkscrews or spirals around direction of propagation 1748. Chiral polarization signal 1745 may also be referred to as a broadband quadrature signal, because in chiral polarization signal 1745 fields will be substantially in quadrature.

Figure 18:
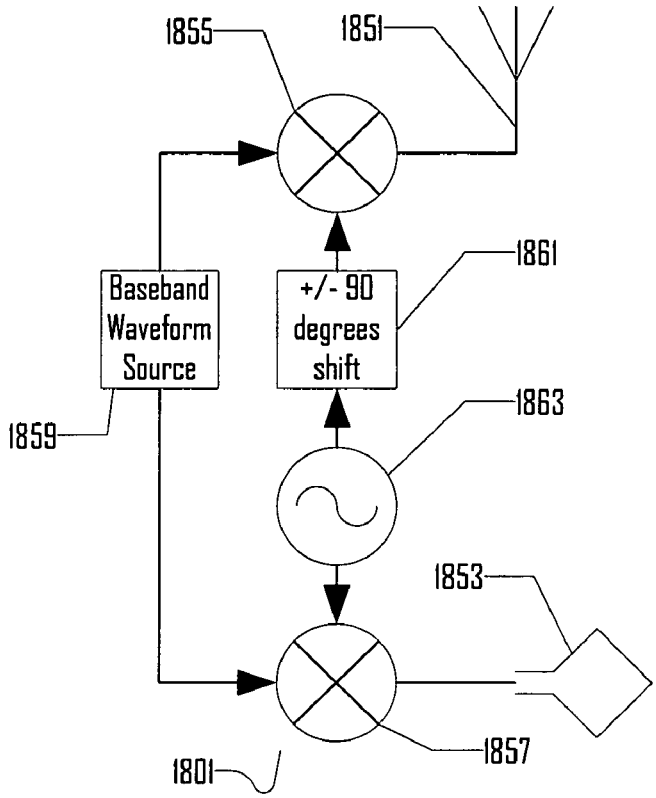
FIG. 18 is a block diagram of a system for transmitting broadband chiral polarized signals.

Quadrature notch 1701 is well suited for transmission or reception of chiral polarized signals like chiral polarization signal 1745. However, quadrature notch 1701 may be advantageously applied to receive or transmit a variety of polarization diverse signals. Broadband quadrature signals are advantageous because when fields are substantially in quadrature there is minimal stored reactive energy System for Transmitting Chiral Polarized Signals FIG. 18 is a block diagram of a system 1801 for transmitting broadband chiral polarized signals. Broadband chiral polarized transmitter system 1801 comprises electric antenna element 1851, magnetic antenna element 1853, electric antenna signal mixer 1855, magnetic antenna signal mixer 1857, local oscillator 1863, quadrature shifter 1861, and baseband waveform source 1859.

Exemplary broadband chiral polarized transmitter system 1801 functions as follows. Baseband waveform source 1859 generates two copies of a baseband waveform. A baseband waveform may be modulated so as to convey data or enhance spectral qualities of radiated signals. A local oscillator 1863 generates a carrier wave. A magnetic antenna signal mixer 1857 combines a carrier wave with a first copy of a baseband waveform and the resulting signal is applied to magnetic antenna element 1853. A quadrature shifter 1861 imparts a 90 degrees phase shift to a carrier wave, an electric antenna signal mixer 1855 combines a 90 degrees shifted carrier wave with a second copy of a baseband waveform, and the resulting signal is applied to electric antenna element 1855.

In alternate embodiments, a carrier wave may be mixed with a first copy of a baseband waveform. The resulting signal is applied to electric antenna element 1851. A 90 degrees shifted carrier wave may be mixed with a second copy of a baseband waveform. The resulting signal is applied to magnetic antenna element 1853. One skilled in the RF arts will realize that there are a variety of ways consistent with the teachings of the present invention to accomplish the generation of quadrature broad band signals.

Local oscillator 1863, and quadrature shifter 1861 constitute a means for generating in phase and quadrature carrier signals. Electric antenna signal mixer 1855, and magnetic antenna signal mixer 1857 constitute mixing means. Baseband waveform source 1859, constitutes a means for generating baseband waveforms. Electric antenna element 1851 and magnetic antenna element 1853 constitute antenna means for radiating polarization diverse signals. An electric magnetic antenna 1501 as taught by the present invention is an example of such antenna means.

Exemplary broadband chiral polarized transmitter system 1801 comprises a means for generating in phase and quadrature carrier signals, mixing means, a means for generating baseband waveforms, and antenna means for radiating polarization diverse signals.

Similarly, local oscillator 1863, quadrature shifter 1861, baseband waveform source 1859, electric antenna signal mixer 1855, and magnetic antenna signal mixer 1857 constitute a means for generating broadband quadrature signals. Thus, exemplary broadband chiral polarized transmitter system 1801 comprises a means for generating broadband quadrature signals and antenna means for radiating polarization diverse signals.

Exemplary broadband chiral polarized transmitter system 1801 yields a pair of broadband quadrature signals with a phase difference substantially equal to ninety degrees across the entire operating bandwidth. Prior art chiral polarized broadband systems yield inferior results because they relay on a delay of one broadband signal with respect to another [for instance, U.S. Pat. No. 5,764,696]. A delay of one broadband signal with respect to another may yield a ninety degree phase shift at one particular frequency (such as a center frequency) but cannot yield a true broadband quadrature relationship of the quality possible from the present system.

System for Receiving Chiral Polarized Signals

Figure 19:
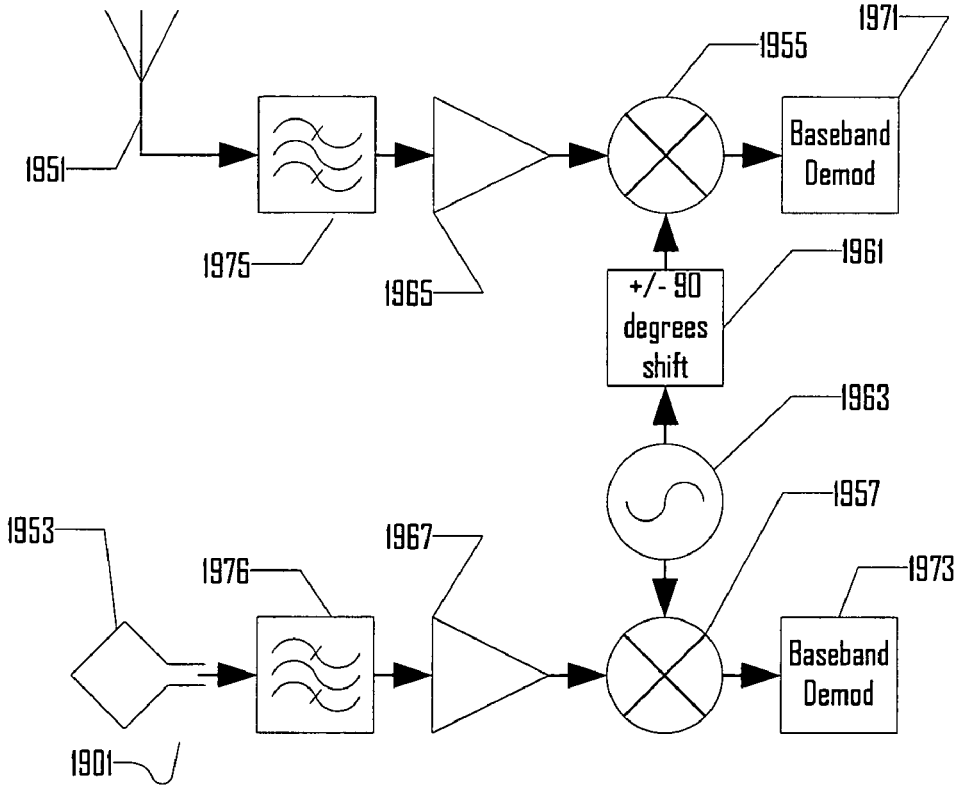
FIG. 19 is a block diagram of a system for receiving broadband chiral polarized signals.

FIG. 19 is a block diagram of a system 1901 for receiving broadband chiral polarized signals. Broadband chiral polarized receiver system 1901 comprises electric antenna element 1951, magnetic antenna element 1953, electric signal bandpass filter 1975, magnetic signal bandpass filter 1976, electric signal amplifier 1965, magnetic signal amplifier 1967, electric antenna signal mixer 1955, magnetic antenna signal mixer 1957, local oscillator 1963, quadrature shifter 1961, electric signal baseband demodulator 1971, and magnetic signal baseband demodulator 1973.

Exemplary broadband chiral polarized receiver system 1901 functions as follows. An electric antenna element 1951 receives a first antenna signal and a magnetic antenna element 1953 receives a second antenna signal. Collectively, electric antenna element 1951 and magnetic antenna element 1953 constitute a antenna means for receiving polarization diverse signals. An electric magnetic antenna 1501 as taught by the present invention is an example of such antenna means.

Electric signal bandpass filter 1961 filters first (or electric) antenna signal, and electric signal amplifier 1965 amplifies a first antenna signal. Electric signal bandpass filter 1975 and electric signal amplifier 1965 constitute reception means for a first antenna signal. Magnetic signal bandpass filter 1976 filters a second (or magnetic) antenna signal, and magnetic signal amplifier 1967 amplifies a second antenna signal. Magnetic signal bandpass filter 1976 and magnetic signal amplifier 1967 constitute reception means for a second antenna signal. These first and second antenna signals are filtered and amplified as is generally well understood by practitioners of the RF arts to yield first and second received signals respectively.

Local oscillator 1963 provides a first copy of a carrier wave and a second copy of a carrier wave (an in phase carrier wave). Quadrature shifter 1961 imparts a 90 degree phase shift to a first copy of a carrier wave to yield a quadrature carrier signal. Local oscillator 1963, and quadrature shifter 1961 constitute a means for generating in phase and quadrature carrier signals.

An electric antenna signal mixer 1955 mixes a first received signal with a quadrature carrier signal (a 90 degree shifted copy of a carrier wave) to create a first baseband signal. A magnetic antenna signal mixer 1957 mixes a second received signal with a carrier wave (an in phase copy of a carrier wave) to create a second baseband signal. An electric antenna signal mixer 1955 and a magnetic antenna signal mixer 1957 constitute mixing means.

An electric signal baseband demodulator 1971 demodulates a first baseband signal, and a magnetic signal baseband demodulator 1973 demodulates a second baseband signal. An electric signal baseband demodulator 1971 and a magnetic signal baseband demodulator 1973 constitute demodulation means. In alternate embodiments a first baseband signal and a second baseband signal may be combined and then demodulated.

Broadband chiral polarized receiver system 1901 comprises antenna means for receiving polarization diverse signals, reception means for a first antenna signal, reception means for a second antenna signal, means for generating in phase and quadrature carrier signals, mixing means, and demodulation means. Collectively, reception means for a first antenna signal, reception means for a second antenna signal, means for generating in phase and quadrature carrier signals, mixing means, and demodulation means together constitute means for receiving broadband quadrature signals. One skilled in the RF arts will realize that there are a variety of ways consistent with the teachings of the present invention to accomplish the reception of quadrature broad band signals.

Although broadband chiral polarized transmitter system 1801 and broadband chiral polarized receiver system 1901 are described for purposes of illustration as separate and distinct systems, both transmission and reception functionality may be combined using transmit receive switching and other techniques well understood in the RF arts.

Quadrature Antenna System

Figure 20:
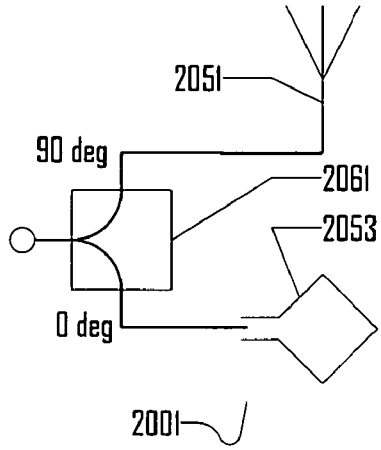
FIG. 20 is a block diagram of a quadrature antenna system.

FIG. 20 is a block diagram of a quadrature antenna system 2001. Quadrature antenna system 2001 comprises electric antenna element 2051, magnetic antenna element 2053, and quadrature shifter 2061. In this alternate embodiment, quadrature shifter 2061 is a device that takes an input signal and splits it into a quadrature (90 degree shifted) signal and an in phase signal. Alternatively, quadrature shifter 2061 is a device that takes a first input signal and a second input signal, shifts a first input signal by ninety degrees and sums a second input signal with a ninety degree shifted copy of a first input signal.

Also, although the present invention is well suited for use with broadband signals, nothing prevents use of antennas herein disclosed in conjunction with ultra-wideband signals, with narrowband signals or other electromagnetic signals.

Specific alternate embodiments have been presented solely for purposes of illustration to aid the reader in understanding a few of the great many contexts in which the present invention will prove useful. It should also be understood that, while the detailed drawings and specific examples given describe preferred embodiments of the invention, they are for purposes of illustration only, that the apparatus and method of the present invention are not limited to the precise details and conditions disclosed and that various changes may be made therein without departing from the spirit of the invention which is defined by the following claims:

I claim:

1. A first broadband electric dipole antenna apparatus, said apparatus comprising:

a first antenna element; and a second antenna element;

where said first antenna element is generally aligned along a z-axis and where said first antenna element further comprises an equipotential tapered element, said equipotential element having a shape substantially defined by a radial coordinate (r) and an angular coordinate (θ), said angular coordinate (θ) describing an angle with respect to said z-axis, said radial coordinate substantially satisfying the relation $r=K\sqrt{\cos\theta}$ where K is a constant.

2. The apparatus in claim 1 further comprising a second broadband electric dipole antenna apparatus, said first broadband electric dipole antenna apparatus being substantially planar;

said second broadband electric dipole antenna apparatus being substantially planar; and said second broadband electric dipole antenna apparatus being substantially orthogonal to said first antenna element.

3. A first broadband magnetic antenna apparatus comprising N lobes wherein said lobes are substantially planar, wherein N is greater than or equal to two ($N \geqq 2$), and wherein there is a common orientation of current circulation in the N lobes.

4. The apparatus of claim 3 further comprising an offset feed.

5. The apparatus of claim 3 further comprising a serrated edge.

6. The apparatus of claim 3 further comprising a second broadband magnetic antenna apparatus comprising N lobes wherein said lobes are substantially planar;

N is greater than or equal to two ($N \geqq 2$); and said second broadband magnetic antenna apparatus is substantially orthogonal to said first broadband magnetic antenna apparatus.

7. A broadband electric-magnetic antenna apparatus, said apparatus comprising:

a broadband electric antenna element and;

a broadband magnetic antenna element said broadband electric-magnetic antenna apparatus further comprising a plurality of quadrature notches.

8. The apparatus in claim 7 further comprising a quadrature phase shifter.

9. The apparatus in claim 7 in which said broadband magnetic antenna element comprises N lobes wherein N is greater than or equal to two ($N \geqq 2$).

10. The apparatus of claim 7 in which said plurality of quadrature notches is M quadrature notches and where M is selected from the set consisting of two (2), three (3), four (4), five(5), and six (6).

11. A broadband chiral polarized transmitter system comprising:

a means for generating broadband quadrature signals; and antenna means for radiating chiral polarized signals, said antenna means further comprising a plurality of quadrature notches.

12. The system of claim 11 wherein a means for generating broadband quadrature signals further comprises:

a means for generating in phase and quadrature carrier signals;

mixing means; and a means for generating a plurality of baseband waveforms.

13. The system of claim 11 wherein said antenna means for radiating polarization diverse signals comprises a broadband electric-magnetic antenna apparatus, said apparatus further comprising:

a broadband electric antenna element and;

a broadband magnetic antenna element comprising N lobes wherein N is greater than or equal to two ($N \geqq 2$), and wherein there is a common orientation of current circulation in the N lobes.

14. A broadband chiral polarized receiver system comprising:

antenna means for receiving chiral polarized signals; and means for receiving broadband quadrature signals said antenna means further comprising a plurality of quadrature notches.

15. The system of claim 14 wherein said antenna means for receiving polarization diverse signals comprises a broadband electric-magnetic antenna apparatus, said apparatus further comprising:

a broadband electric antenna element and;

a broadband magnetic antenna element comprising N lobes wherein N is greater than or equal to two ($N \geqq 2$), and wherein there is a common orientation of current circulation in the N lobes.

16. The system of claim 14 wherein said means for receiving broadband quadrature signals further comprise:

reception means for a first antenna signal;

reception means for a second antenna signal;

means for generating in phase and quadrature carrier signals;

mixing means;

and demodulation means.

* * * * *